US007497097B2

(12) United States Patent
Herr

(10) Patent No.: US 7,497,097 B2
(45) Date of Patent: Mar. 3, 2009

(54) SWEAT BLOCKING AND VENTILATING SWEATBAND FOR HEADWEAR

(75) Inventor: Paul Herr, 14 E. Geneva Cir., Madison, WI (US) 53717

(73) Assignee: Paul Herr, Madison, WI (US)

( * ) Notice: Subject to any disclaimer, the term of this patent is extended or adjusted under 35 U.S.C. 154(b) by 569 days.

(21) Appl. No.: 11/147,297

(22) Filed: Jun. 8, 2005

(65) Prior Publication Data

US 2006/0277951 A1 Dec. 14, 2006

(51) Int. Cl.
*D04B 1/24* (2006.01)

(52) U.S. Cl. ..... 66/170; 66/195; 2/181

(58) Field of Classification Search ..... 66/169 R, 66/170, 171, 172 R, 195, 196; 2/181, 182.1, 2/182.3, 182.8

See application file for complete search history.

(56) References Cited

U.S. PATENT DOCUMENTS

| | | | | |
|---|---|---|---|---|
| 4,024,586 | A * | 5/1977 | Lamb | 2/414 |
| 4,274,157 | A | 6/1981 | Boden | |
| 4,292,689 | A | 10/1981 | Townsend, Jr. | |
| 5,101,516 | A | 4/1992 | Scarnato | |
| 5,157,788 | A | 10/1992 | Schultz | |
| 5,625,901 | A | 5/1997 | Healy | |
| 5,630,230 | A | 5/1997 | Fujino et al. | |
| 5,887,276 | A | 3/1999 | Lee | |
| 6,138,280 | A | 10/2000 | Bae | |
| 6,779,369 | B2 * | 8/2004 | Shepherd | 66/196 |
| 6,893,695 | B2 * | 5/2005 | Baychar | 428/36.1 |
| 7,043,767 | B2 * | 5/2006 | Jaeger | 2/87 |
| 7,276,275 | B2 * | 10/2007 | Schindzielorz et al. | 428/86 |
| 7,314,840 | B2 * | 1/2008 | Baychar | 442/370 |

FOREIGN PATENT DOCUMENTS

| | | |
|---|---|---|
| EP | 0988804 A2 | 3/2000 |
| GB | 2341784 A | 3/2000 |

* cited by examiner

*Primary Examiner*—Danny Worrell
(74) *Attorney, Agent, or Firm*—Galvin & Palmer; Sheldon Palmer

(57) ABSTRACT

A spacer-fabric sweatband, for, and incorporated into headwear which has an inner, skin-contact fabric layer, and an outer, headwear-facing fabric layer connected by a multiplicity of hydrophobic monofilament-pile spacing elements. The pile spacing elements function like thousands of miniature springs to maintain the fabric layers in uniform spaced parallel relation while creating substantial, pile-supported airspace between the fabric layers to facilitate the movement of ventilating airflow. The headwear-facing fabric layer is mesh-like for enhanced air circulation. The skin-contact layer is composed of solid skin-friendly fabric.

The pile segments block sweat from migrating from the inner to the outer fabric layers by virtue of their hydrophobic composition. This sweat-blocking function minimizes the occurrence of sweat stains on the body of the headwear and concentrates sweat within the skin-contact fabric layer, from which it is subsequently subject to evaporation and concomitant cooling by air flowing through the pile-supported airspace.

18 Claims, 3 Drawing Sheets

FIG.2
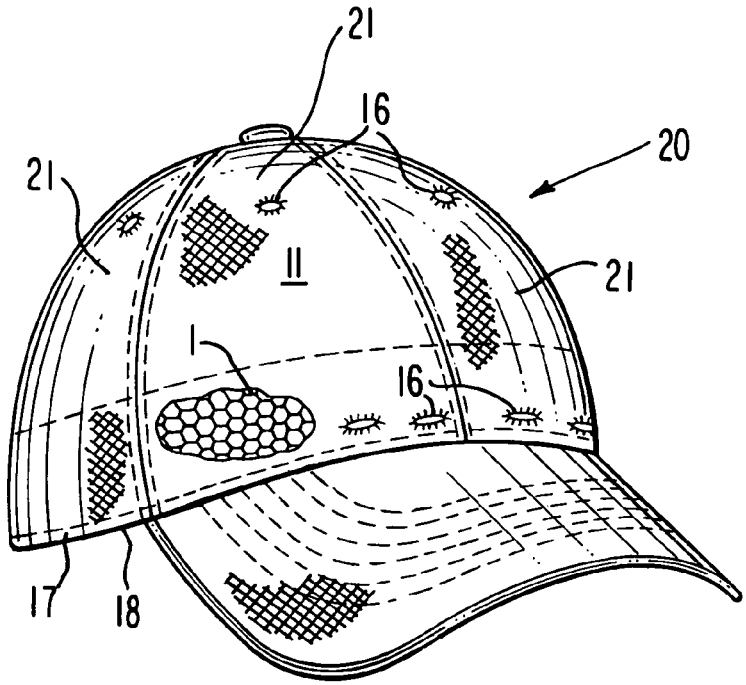
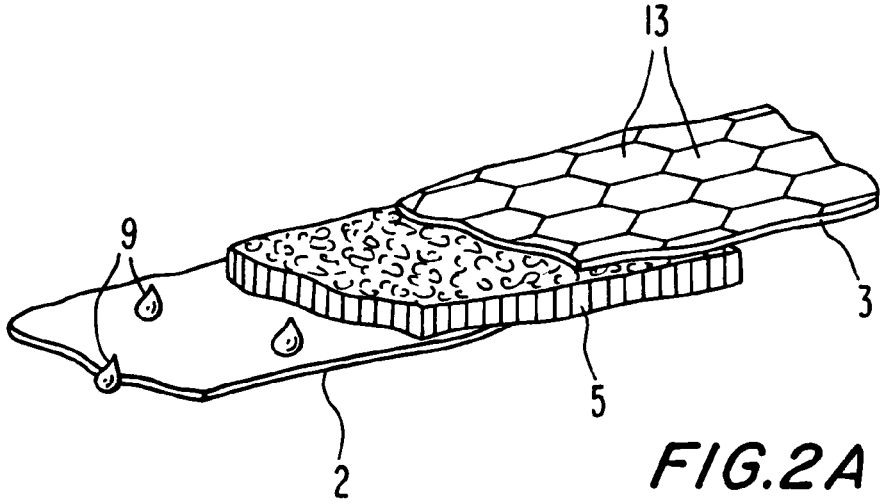
FIG.2A

SWEAT BLOCKING AND VENTILATING SWEATBAND FOR HEADWEAR

CROSS-REFERENCE TO RELATED APPLICATIONS

None

BACKGROUND OF THE INVENTION

1. Field of the Invention

The present invention relates to inside hat bands which are sometimes also referred to as sweatbands, and more particularly to a hat band that provides comfort, ventilation, cooling and sweat-stain-blocking functions.

2. Description of the Related Art

Headwear is often worn in warm conditions in order to protect the head from sunlight and/or physical injury (for example, cycle, sport, emergency personnel, construction and military helmets), or simply for esthetic reasons. The head is also one of the human body's primary heat radiators, or heat loss sites. Thus, placing headwear over the head in a warm environment quickly leads to overheating and profuse sweating. In conventional headwear, sweat is absorbed by the sweatband-portion of the headwear and often migrates by capillary action from the sweatband into the body of the headwear itself, producing unsightly exterior sweat stains that are difficult or impossible to remove. Many of these sweat-stained hats and caps are either discarded or linger unworn in closets. The skin-contact portion of the headband also creates an uncomfortable hot-spot on the users head.

As is well known to those skilled in the art, a sweatband for headwear is a band lining the inside edge of a hat or cap to protect it against the sweat from the wearer's head and provide a comfortable fit for the wearer.

There are disclosed in the prior art various means for providing a ventilating space to separate the skin-contact surface of the sweatband from the main body of the headwear by using spacing elements, and thereby provide a ventilating and cooling effect to the wearer. None of these ventilating sweatband designs also simultaneously block sweat-stains. The sweatband designs proposed in the prior art have been either costly or inconvenient to make, impractical to use, uncomfortable, non-esthetic, or difficult to incorporate into existing headwear designs. U.S. Pat. No. 5,157,788 discloses a ventilating spacing element formed of molded plastic. A sweatband design containing a plastic insert such as this would likely be uncomfortable to wear and difficult to incorporate into existing headwear because of the difficulty of conforming semi-rigid plastic to the complex shapes of headwear. U.S. Pat. No. 5,101,516 describes spacing elements composed of absorbent sponge balls. Multi-element designs of this sort are costly and inconvenient to manufacture. Using sponge, or other hydrophilic materials, as spacing elements would not provide a sweat-stain-blocking function. Rather, the sponge or other hydrophilic material would absorb and transmit the moisture. U.S. Pat. No. 4,274,157 describes spacing elements composed of tubes of flexible material. Designs such as this, with only a small number of spacing elements, would be uncomfortable to wear because of pressure-points at the locations of the spacing-element attachment and would not provide consistent spacing of the sweatband from the headwear because of the limited number of proposed spacing elements. U.S. Pat. No. 5,625,901 describes spacing elements formed of a "plurality of flexible fingers" composed of injection-molded thermoplastic material. Designs such as this, where stiff, plastic, spacing-elements come in direct contact with the user's head create uncomfortable pressure points and leave indentations in the skin surface if worn for any significant period of time. U.S. Pat. No. 4,292,689 describes a spacing element composed of a sinusoidal foam band. This type of design, where foam spacing elements come in direct skin contact, create pressure points and uncomfortable hot-spots at the points of skin contact.

Fabric-type spacing elements have also been proposed. U.S. Pat. Nos. 5,630,230 and 5,887,276 describe spacing elements consisting of hydrophilic, non woven, water-absorbent pads. These pads are designed to be hydrated before use by plunging the headwear into a bath of water. Designs that need to be hydrated before use are not a practical solution for many headwear applications. Designs with hydrophilic pads would absorb and transmit sweat and therefore would not provide a sweat-blocking function.

There are relatively few disclosures in the prior art of designs that provide sweat-stain-blocking functions. U.S. Pat. No. 6,138,280 describes a laminated sweatband structure composed of both sweat absorbing and sweat blocking non-woven fabric layers. The non-absorbent, sweat-blocking layer is a non-woven fabric strip coated with a hydrophobic synthetic resin. The non-absorbent layer is intended to keep sweat from reaching and wetting the crown of the hat or cap. This sweatband design is described as able to effect blocking of wetting, but does not purport to simultaneously provide ventilation or cooling.

Additional relevant prior art includes U.S. Pat. No. 6,755,052, which discloses a knitted stretch spacer material and method of making it; U.S. Pat. No. 6,644,070 which discloses a three-dimensional fabric for a seat; U.S. Pat. No. 5,896,758 which discloses a three-dimensional knit spacer fabric for footwear and backpacks; U.S. Pat. No. 5,817,391 which discloses a three-dimensional knit spacer fabric for bed pads; U.S. Pat. No. 5,746,013 which discloses a shoe having an air-cooled breathable shoe liner; and U.S. Pat. No. 6,105,401 which discloses a knitted textile structure with double skin and adjustable binding threads. Finally, there is a commercially available device described in UK Patent 2,341,784; U.S. Pat. No. 6,199,214 and European Patent Application 99 307 488.9. This device is intended to be added to caps to improve their ventilating and sweat blocking functions.

BRIEF SUMMARY OF THE INVENTION

Spacer fabrics have been incorporated into in a variety of consumer products in recent years in applications where comfort and heat and moisture-elimination are desirable. Spacer fabrics can be found in products such as shoes, foundation garments, other articles of wearing apparel, backpacks, gloves, medical supports and wraps, athletic wraps and braces, etc., worn on the body.

The present invention incorporates a spacer fabric into articles of headwear, said spacer fabric functioning as a sweatband. The spacer fabric used in this invention is so configured as to minimize headwear sweat-staining while simultaneously enhancing ventilation, evaporative cooling and comfort. These properties or functions, especially when considered in connection with sport or exercise apparel are sometimes referred to by the term moisture management.

In order to effectuate the objects of this invention, it should be noted that only a specialized subset of spacer fabrics possess the physical properties needed to simultaneously provide comfort, flexibility, moisture-blocking, and ventilation. An aspect of the invention is therefore the careful selection of pile yarn composition (it must be hydrophobic), pile yarn type (monofilament), pile thickness (3-12 mm), aperture diameter (1-12 mm) and aggregate aperture area as great as is practicable for the headwear facing outer fabric layer, but preferably greater than 50%. A second aspect of the invention is the mode of attachment. If the sweatband is irreversibly compressed by the attachment process, for example by stitching it into the headwear using standard sewing equipment, its moisture-blocking property will be defeated. It is therefore important that the spacer fabric sweatband be attached in an uncompressed state, for example, by gluing it into the headwear using either a dry or wet adhesive, and in the former case, by inserting a dry adhesive strip between the headwear and the sweatband, and then heating to the point of melting the adhesive. Attaching the spacer fabric in the uncompressed state also maximizes ventilation and evaporative-cooling properties of the material by maintaining open routes of ingress and egress for airflow. A third aspect of the invention, preferable but not necessary, is the inclusion, in some applications such as baseball caps, of carefully placed vents in the crown of the hat that correspond to the location of the spacer fabric sweatband. Such vents work synergistically with the apertures in the headwear-facing surface of the spacer-fabric sweatband to direct airflow to the skin-contact or inner surface of the spacer fabric sweatband where evaporative cooling occurs.

The spacing elements according to the present invention, unlike those in the prior art, comprise thousands of thin, flexible, hydrophobic, monofilament pile fibers arrayed at precise intervals inside a specially-designed spacer fabric. The pile spacing elements are an integral part of spacer fabrics and are incorporated into them during the knitting process by which they are made. The monofilament pile spacing elements function to maintain a precise degree of separation between the two layers forming the spacer fabric, i.e., an inner, or skin facing layer and an outer, or headwear facing layer, thereby creating a pile-supported airspace that both blocks sweat migration and provides a maximum of ventilating airspace. The thin, flexible and spring-like nature of the monofilament spacing elements ensures a comfortable fit for the wearer that is free of pressure points.

The pile-substructure inside the spacer fabrics provides several potentially significant advantages over other spacing-elements proposed for sweatbands.

First, spacer fabrics not only provide a pile-supported airspace to maximize ventilating airflow and cooling, but they simultaneously provide a means for minimizing sweat stains by blocking the migration of sweat from the sweatband to the body of the hat, cap or other headwear. Hydrophobic monofilament pile yarns, such as polyester, can be used to create a sweat-barrier between the sweat-saturated, skin-contact, inner fabric layer of the spacer fabric and the headwear-facing outer fabric layer. Sweat remains on the inner, skin-contact fabric layer of the spacer fabric from which it is dissipated into the pile-supported airspace by evaporation. Evaporation, and concomitant evaporative cooling, is enhanced in this invention by advective and convective airflow through the pile-supported airspace.

Second, the spacer fabric of present invention can be mass produced cheaply, and in one production step, using, for example, double needle bar Raschel warp knitting machines or other machines capable of manufacturing spacer fabrics, such as circular dial and cylindrical machines, V-bed knitting machines, looms and 3-D weaving machines. It is therefore an advance over sweatbands featuring complicated multi-component spacing-elements.

Third, spacer fabrics are extremely lightweight in comparison to their thickness because of the large amount of internal void space contained between the spaced-apart layers. In addition, the flexible monofilament pile spacing elements act like tiny, independent "springs" to evenly distribute pressure between the headwear and the wearer's head. These features enhance the wearability and comfort of the spacer fabric sweatband compared to other ventilating sweatband spacer structures, particularly those involving plastic spacing elements or those with limited numbers of spacing elements.

Fourth, machines such as double needle bar Raschel warp knitting machines can be configured in many different ways to create spacer-fabric sweatbands that are precisely tailored to various applications. For example, the machine can be configured to produce either solid fabrics or mesh-like fabrics with a plurality of spaced apertures. The machine can be configured so the fabric layers consist of one type of yarn, or two, or more, different yarns. The machine can also be configured to vary the pile height (this controls thickness of the spacer fabric), yarn diameter (this controls the resiliency of the pile spacer elements and the softness and feel of the inner skin-contact layer), pile density (this controls the air permeability and compressibility of the pile). All of these machine-variable parameters can be optimized to maximize the ventilating and sweat-blocking properties of the spacer-fabric sweatband for various applications.

Fifth, spacer fabrics are extensible and flexible and therefore easily conform to the shape of the headwear. A sweatband containing spacer elements composed of rigid or semi-rigid material, such as a molded-plastic, would not easily conform to the headwear and could therefore not be efficiently incorporated into headwear such as baseball caps without affecting the shape of the headwear.

BRIEF DESCRIPTION OF THE SEVERAL VIEWS OF THE DRAWINGS

FIG. 2 is a perspective view of a cap fitted with a spacer fabric sweatband.

FIG. 2A is a perspective view of an enlarged representative portion of the spacer fabric sweatband removed from the cap.

DETAILED DESCRIPTION OF THE INVENTION.

Figure 1:
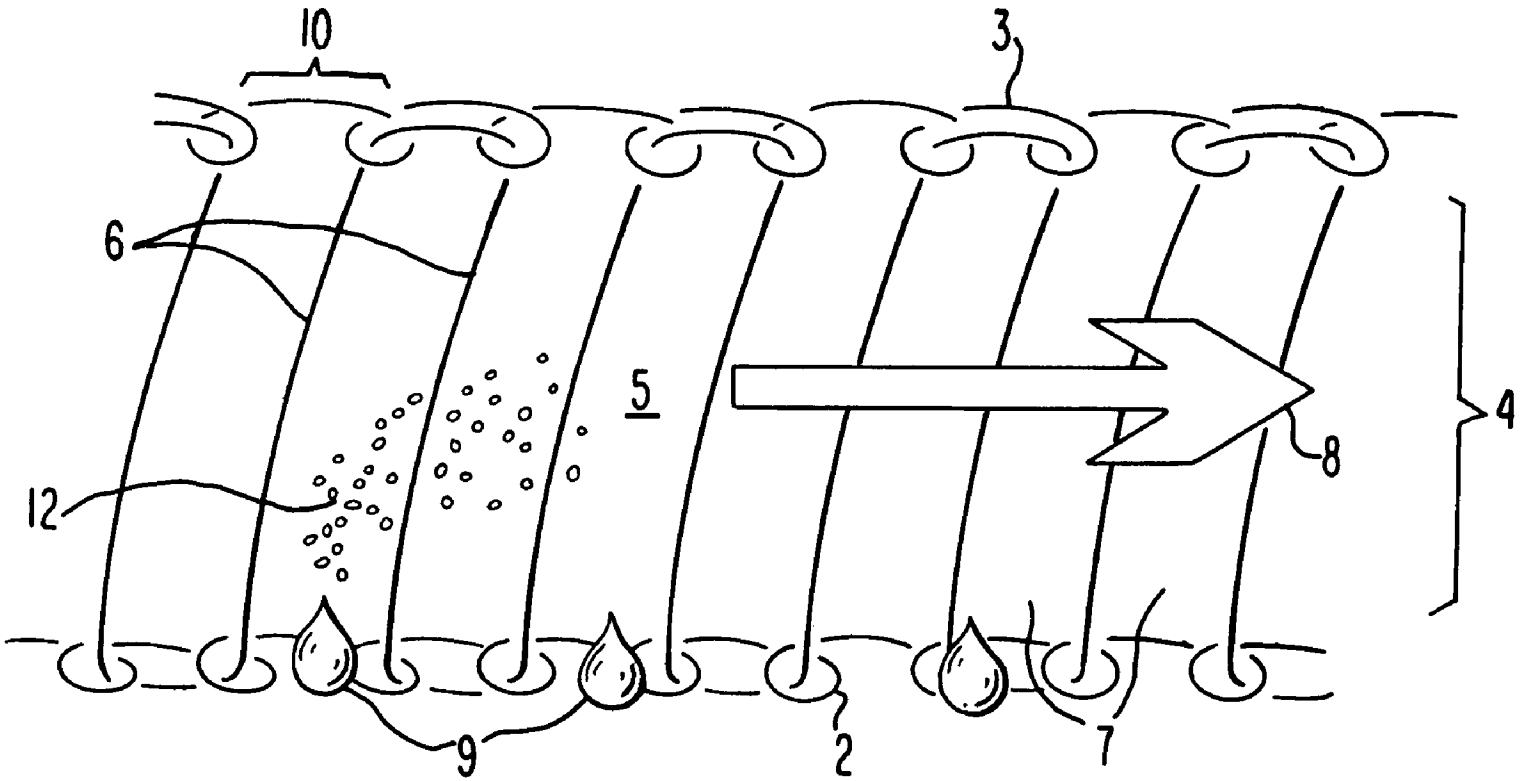
FIG. 1 is a side view of a spacer-fabric material of the type used in the invention and illustrating the basic geometry of spacer fabrics.

Referring now to the drawings, and first to FIG. 1, the spacer-fabric sweatband comprises inner (skin-contact) 2 and outer (headwear-facing) 3 fabric layers connected in spaced 4 relation by monofilament pile yarn(s) in a pile substructure 5 integrated with and extending between the layers 2 and 3 to form pile spacing elements 6 extending transversely between the layers at regular intervals throughout the spacer fabric. The pile spacing-elements 6 maintain the layers 2 and 3 in spaced 4 parallel relation yet are resiliently compressible and maintain considerable open pile-supported airspace 7 between the layers 2 and 3 to facilitate the movement of ventilating airflow shown by arrow 8. The transverse pile spacing-elements 6 also function to block sweat 9 migration from the inner, skin-contact layer 2 to the outer, headwear-facing layer 3 by virtue of their hydrophobic composition and selection of a spacing-interval 10 between spacing-elements 6 that inhibits capillary action. This sweat-blocking function minimizes the occurrence of sweat stains on the crown of the headwear and concentrates sweat within the wicking, inner, skin-contact layer 2, from which it is subsequently subject to evaporation 12 and concomitant cooling by airflow 8 through the pile-supported airspace 7. The thin and flexible spacing elements 6 also act like thousands of independent "springs" to provide a comfortable fit without pressure points on the wearer's head.

The spacer fabric used in the preferred embodiment of this invention is manufactured using conventional double needle bar Raschel warp knitting machines. Double needle bar Raschel warp knitting machines can be configured in many different ways to efficiently create a wide variety of spacer fabrics with properties tailored to various sweatband/pad applications. As shown in FIG. 2A, the machine can be configured to produce either solid fabrics 2 or mesh-like fabrics 3 with a plurality of spaced apertures 13 and with either smooth or rough textures. The machine can be configured so the layers 2 and 3 comprise one type of yarn, or two, or more, different yarns. Referring back now to FIG. 1, the machine can also be configured to vary the height, diameter, composition and density (pile fibers per square inch) of pile spacing elements 6. All of these machine-variable parameters are optimized in the current invention to maximize the sweat-blocking, ventilating and comfort properties of the spacer-fabric sweatband.

It is an object of the present invention to provide a new use of spacer fabrics of the double needle bar Raschel pile type in the area of ventilating and sweat-stain-blocking headband designs. Spacer fabrics suitable for this invention are manufactured by John Heathcoat & Co. Ltd in Great Britain, Muller Textile in Germany and by other manufacturers. The spacer fabric used for this invention has a thickness, pile-fiber density (pile fibers per square inch), pile fiber composition, and inner and outer ground layer parameters optimized to enhance airflow, evaporative cooling, sweat-stain blocking and comfort.

Referring now to FIG. 2A, the preferred embodiment of the present invention utilizes a spacer fabric that has a thickness of 3 to 12 mm and has 1-12 mm diameter apertures 13 on the outer, headwear-facing layer 3 of as great an extent as is practicable for the headwear facing outer fabric layer, but preferably greater than 50%, and no apertures on the inner skin-contact layer 2. Spacer-fabric design 84/2000, manufactured by Karl Mayer GmbH, meets the above requirements for a spacer-fabric sweatband.

Spacer fabrics of the desired type can be manufactured in webs of varying lengths and widths using a double needle bar Raschel warp knitting machine and passed to a production line for incorporation into headwear, or (either directly or after intermediate storage) in the form of rolled-up webs to await further processing.

The next step in the production of the spacer-fabric sweatband is the cutting step. A clean cut is desirable for aesthetic reasons. The preferred embodiment of the cutting step involves first cutting the rolled up webs of spacer fabric, using, for example, a conventional slitter such as a Judelshon slitter, followed by lengthwise cutting, also using conventional strip cutters, for example, an Eastlex strip cutter. Numerous other cutting technologies that might be applied are radio-frequency die cutting, sonic slitting, laser cutting, hand cutting or high-pressure water-jet cutting. The spacer fabric will be cut into strips roughly 1 to 3 inches wide and in lengths appropriate to the circumference of the headwear or into pads of various shapes.

Figure 3:
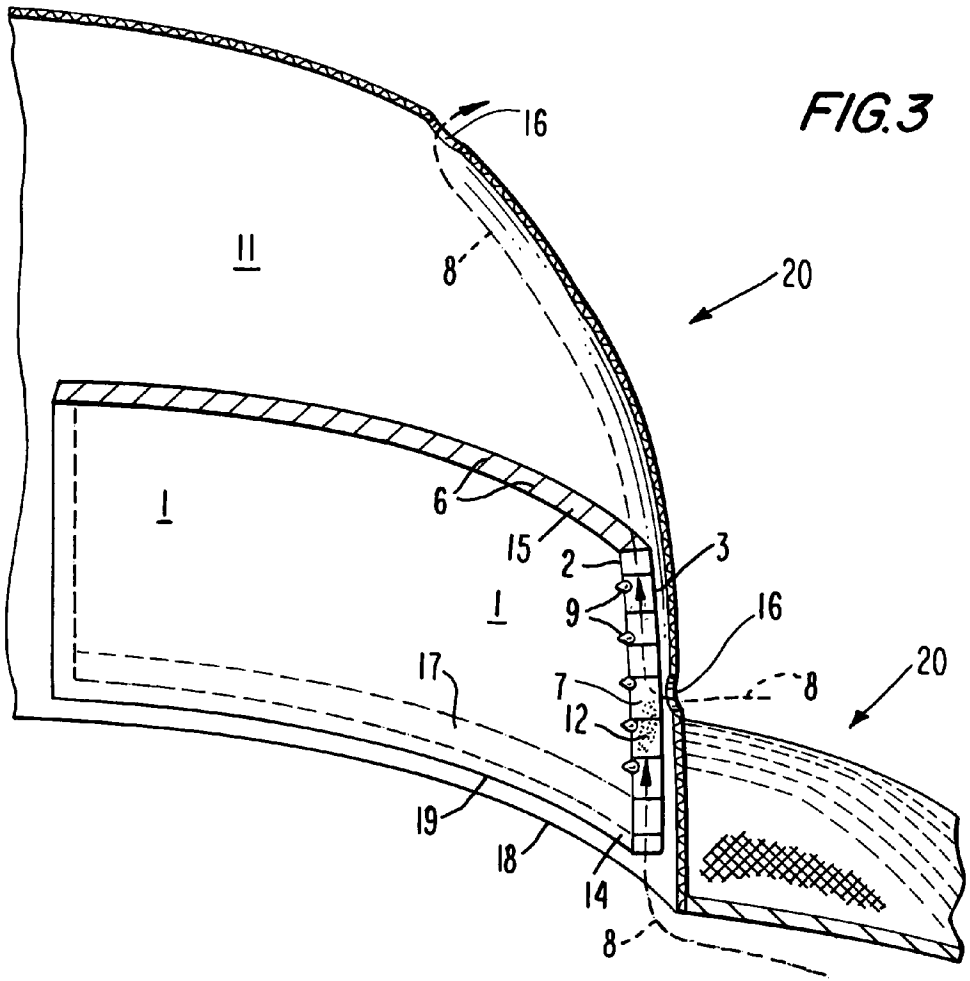
FIG. 3 is a vertical, longitudinal cross-section view through a cap fitted with a spacer-fabric sweatband showing two pathways for ventilating airflow.

Referring now to FIG. 3, and as shown therein, it is important in the present invention to provide for ventilating airflow 8 inside the pile-supported airspace 7, otherwise, the air inside the pile-supported airspace 7 will be trapped and become stagnant. In this event, the spacer fabric will exhibit insulating properties instead of cooling properties.

The present invention provides two pathways for ventilating airflow:

1) Airflow 8 (the direction of the lower arrow in FIG. 3) through the pile-supported airspace 7 by way of the open leading 14 and trailing edges 15 of the spacer fabric sweatband 1. The open leading 14 and trailing 15 edges provide entry and exit points for airflow 8 moving through the pile-supported airspace 7. Airflow 8 parallel to the layers 2 and 3 is achieved by maintaining the leading 14 and trailing 15 edges of the headband 1 in an open configuration rather than in a compressed, or closed, configuration. The open configuration is achieved by gluing, or otherwise attaching, the uncompressed spacer fabric into the headwear rather than by stitching it into the headband. Stitching the spacer fabric into the headwear tends to compress the spacer fabric and thereby impedes airflow 8 parallel to the layers 2 and 3 from entering or exiting the pile-supported airspace 7.
2) The outer layer 3 is perforated with an array of ventilation apertures 13. These apertures 13, along with vents in the crown of the headwear 16, allow ventilating airflow 8 to travel into, and through, the pile-supported airspace 7 and provide cooling to the sweat-saturated layer 2. This airflow 8 enters the pile supported airspace 7 roughly perpendicular to the outer layer 3 and then fans out inside the pile-supported airspace. The surface area comprised of apertures on the outer, layer 3 should be as large as is practicable, preferably greater than 50%.

The sweat-blocking function of the spacer fabric requires that the pile substructure be sufficiently resilient to keep the inner 2 and outer 3 layers in spaced relation even when the headwear is worn snugly on the head. Full compression of the pile substructure, for example by stitching, would allow sweat 9 to migrate from the inner layer 2 to the outer layer 3 and from there to the crown of the headwear 11 by capillary action.

The ease with which air can flow through the pile-supported airspace 7 is inversely proportional to the density of pile spacing elements 6 (pile fibers per unit area). It is therefore important to have enough pile spacing elements 6 per unit area to keep layers 2 and 3 in spaced relation (to allow for airflow 8 and simultaneously to block sweat 9) but not so many as to impede the ventilating airflow 8 or induce capillary action.

The finished sweatbands are preferably glued directly to headwear using wet or dry adhesives. They may also be removably attached to the headwear using snaps or hook-and-loop-style (Velcro®) fasteners to facilitate removal and laundering. Conventional stitching is also possible but must be carefully done to avoid compressing the spacer fabric and defeating its sweat-blocking function. The area of attachment for the preferred embodiment is a thin strip 17 (0.2 to 0.5 inches wide) running along the inside lip 18 of the headwear crown 11. Spacer fabrics are stiff enough to stand erect under their own weight from a rather narrow attachment strip 17 located at the lowermost margin 19 of the sweatband.

It is contemplated that spacer fabrics according to the present invention will find numerous and varied applications and uses, including substantially any application in which headwear is worn in a warm environment or in which headwear is worn in a cold environment under conditions of heavy exertion or poor internal air circulation. In particular, but without limitation, the present invention contemplates that especially advantageous use can be made of the present spacer fabrics as ventilating and sweat-blocking head-band, or other ventilating components, in baseball-style caps; motorcycle, bicycle, snowmobile and other type of vehicular helmets; construction hardhats and similar construction-trade or manufacturing helmets and headwear; helmets, hats and headwear worn by firefighters and other emergency-response personnel; helmets, hats, and headwear worn by military and security personnel; helmets, hats, and headwear worn by athletes and sport enthusiasts in such sports as hockey, baseball, football, boxing, martial arts, lacrosse, rugby, skiing, equestrian, snowboarding, whitewater rafting and extreme sports; hats and headwear worn by medical, dental or other professional personnel or assistants; and hats, caps and headwear worn strictly for esthetic reasons.

It should be recognized by those persons skilled in the art that the foregoing applications and uses are merely exemplary and not exhaustive. Numerous other varied uses and applications are contemplated to be within the scope of the present invention such as ventilating spacer-fabric pads for specialty headwear such as welders masks, sport face-protective masks, goggles, and other specialty headwear with contact points in the skin/face/scalp regions as well as hats and headwear partially, or fully, constructed from spacer fabrics for ventilating or sweat-blocking purposes. For example, a six-panel baseball-style cap 20, as shown in FIG. 2 could be constructed with all six component panels 21, as well as the band area 1, composed of ventilating spacer-fabric material. Sweat-blocking and ventilating pads for clothing is another contemplated use. For example sweat blocking and ventilating pads in the collar area, shoulder area, or back of shirts and blouses.

To summarize some of the defining characteristics of the invention, the following is a discussion of the characteristics of the pile yarn which separates the two fabric layers of the spacer fabric.

In the case of spacer fabrics generally, an inherent property of some such spacer fabrics, for example, those made with hydrophobic monofilament pile yarn, is moisture blocking. However, there are many different types of spacer fabrics, and only a selected subset of these will provide a moisture blocking function in the material. There are a number of important, if not critical, parameters required to achieve a moisture blocking function in a spacer fabric. Among these are the following:

1. Monofilament Pile Yarn

In order to achieve the desired moisture blocking function, it is important that the pile yarn be monofilament and not multifilament. This was established by us by testing a sample of spacer fabric "Design 97/2000" by Karl Meyer GmbH, by laying it on a wet surface. The pile yarn of this test sample was a multifilament polyester. This test sample failed the moisture blocking test even though the pile fibers were of hydrophobic polyester. The precise reason for this is uncertain, but may be related to the fact that in 97/2000, the multifilament polyester pile yarn consists of tightly spaced individual fibers, which create small "channels" between the fibers that may allow capillary movement of moisture through the pile structure. This apparent capillary movement of moisture occurs despite the fact that the fibers are hydrophobic polyester.

2. Hydrophobic Pile Yarn

In order to achieve the desired moisture blocking function, it is important that the pile yarn be hydrophobic. The pile yarn used in the baseball test cap described on page 13 is a hydrophobic polyester. The hydrophobic character of the pile yarn is a necessary, but not, in and of itself, sufficient property for achieving the moisture blocking function. The moisture blocking function of a hydrophobic pile yarn will be negated if the pile fibers are too numerous, as the test of the 97/2000 fiber showed, above. Indeed, the test of 97/2000 shows how even a hydrophobic polyester yarn can be induced to transmit moisture if narrow enough channels are created between the pile fibers as a result of using a multifilament pile yarn rather than a monofilament.

3. Spacer Fabric with Sufficient Resiliency (Compressive Strength)

In order to achieve the desired moisture blocking function, it is important that the pile yarn be sufficiently resilient to maintain a critical spacing distance between the two fabric layers even when the headwear incorporating the spacer fabric is worn snugly on the head. The pile yarn in the spacer fabric of the baseball test cap described on page 13 has a pile length of 5 mm. This provides an uncompressed spacing distance of 3.5 mm between the fabric layers. The fabric spacing interval is less than the pile fiber length because the pile fibers are not straight, but curved. A spacing distance of about 3.5 mm is sufficient to inhibit moisture migration.

If the pile yarn is not sufficiently resilient, the two fabric layers will come in contact during use, thus providing a pathway for moisture by capillary action. There are a number of variables that affect the resiliency of the pile structure:

(a) composition of the pile yarn—different materials have different moduli of resilience; (b) diameter of the pile yarn—narrow pile fibers will exhibit less resiliency (stiffness) than large diameter pile fibers; (c) length of the pile yarn—long pile fibers will exhibit less resiliency than short fibers; and (d) number of pile fibers per unit area—The density of pile fibers will affect the aggregate resiliency of the spacer fabric. More fibers per unit area result in less compressive strength on each individual pile "spring", and thus less compression of the aggregate fabric under conditions of applied pressure. However, if the number of pile fibers exceeds a critical, but unknown, number, capillary movement of moisture will be triggered, thus defeating the moisture blocking function.

To demonstrate and test the efficacy of the invention, a baseball cap fitted with a spacer-fabric sweatband of the invention was tested during moderate to strenuous exercise under warm, tropical conditions (Virgin Islands), warm, arid conditions (Arizona), warm, temperate conditions (Wisconsin) and warm, maritime conditions (Germany), with absolutely no sweat staining of the crown or visor of the cap. A noticeable evaporative-cooling effect was observed when the skin-contact surface of the sweatband was moist with sweat and airflow was induced inside the pile-supported airspace of the sweatband by physical movement or by wind. In no instance did sweat drip into the eyes of the user. Rather, it remained on the skin-contact surface and was subsequently evaporated into the pile-supported airspace.

The invention claimed is:

1. The combination of (a) an article of headwear having head facing and outward facing surfaces and (b) a sweat blocking and ventilating sweatband formed of a spacer fabric sweatband which comprises an inner, skin contacting layer, an outer headwear facing layer, said inner and outer layers being connected by and spaced apart from one another by a plurality of compressible monofilament spacing elements which maintain the inner and outer layers in spaced parallel and compressible relationship, said sweatband being affixed to the head facing surface of the headwear by means for securing the sweatband to the head facing surface of the headwear without compressing the spacer fabric to an extent such that the distance between the inner and outer layers is reduced sufficiently to prevent the flow of air and evaporated sweat between the inner and outer layers and concomitantly permit sweat to pass by capillary action from the inner layer to and through the outer layer resulting in sweat coming in contact with the headwear article itself.

2. The combination as claimed in claim 1, wherein the monofilament spacing elements of the spacer fabric sweatband are comprised of a hydrophobic pile yarn.

3. The combination as claimed in claim 2, wherein the hydrophobic pile yarn is a monofilament yarn.

4. The combination as claimed in claim 3, wherein the monofilament yarn is a polyester.

5. The combination as claimed in claim 2, wherein the spacing elements are of a length sufficient to create a pile thickness of about 3 to 12 mm.

6. The combination as claimed in claim 1, wherein the outer layer includes a plurality of apertures of about 1 to 12 mm diameter.

7. The combination as claimed in claim 6, wherein the apertures cover more than 50% of the surface area of the outer layer.

8. The combination as claimed in claim 1, wherein the spacer fabric sweatband is affixed to said head facing surface of the headwear by an adhesive placed at a sufficient number of places, and in sufficient amount on either or both of the head facing surface or the outer layer of the sweatband to secure the sweatband to the hat.

9. The combination as claimed in claim 1, and further comprising a plurality of hook and loop attachments placed on the head facing surface of the headwear and the outer surface of the sweatband sufficient to removably secure the sweatband to the hat.

10. The combination as claimed in claim 1, wherein the spacer fabric sweatband is affixed to the hat by stitching.

11. The combination as claimed in claim 1, wherein the headwear further comprises a plurality of spaced apart vents opening on the headwear facing layer of the spacer fabric sweatband.

12. The combination as claimed in claim 1, wherein the headwear is a baseball type cap comprising a bill and a crown, and further comprising a plurality of spaced apart vents in the crown adjacent its juncture with the bill, and opening on the headwear facing layer of the spacer fabric sweatband.

13. The combination as claimed in claim 1, wherein the headwear is a hat comprising a crown and a brim circumferentially surrounding said crown, and further comprising a plurality of spaced apart vents in the crown adjacent its juncture with the brim, and opening on the headwear facing layer of the spacer fabric sweatband.

14. The combination as claimed in claim 11, wherein the vents are about 4-8 mm in diameter.

15. The combination as claimed in claim 12, wherein the vents are about 4-8 mm in diameter.

16. The combination as claimed in claim 13, wherein the vents are about 4-8 mm in diameter.

17. The combination as claimed in claim 1, wherein the sweatband is of a length sufficient to allow affixation thereof to the head facing surface of the headwear from a point adjacent one ear of a wearer, to and around the front of the headwear and continuing to a point adjacent the other ear of a wearer.

18. The combination as claimed in claim 1, wherein the sweatband is of a length sufficient to allow affixation thereof to the head facing surface of the headwear throughout the entire circumference of the headwear.

* * * * *